US006181232B1

(12) United States Patent
Kitamura

(10) Patent No.: US 6,181,232 B1
(45) Date of Patent: Jan. 30, 2001

(54) COIL ELEMENT

(75) Inventor: Hidekazu Kitamura, Sagamihara (JP)

(73) Assignee: Murata Manufacturing Co., Ltd., Kyoto (JP)

( * ) Notice: Under 35 U.S.C. 154(b), the term of this patent shall be extended for 0 days.

(21) Appl. No.: 09/121,245

(22) Filed: Jul. 23, 1998

(30) Foreign Application Priority Data

Aug. 4, 1997 (JP) ..... 9-221892

(51) Int. Cl.[7] ..... H01F 5/00

(52) U.S. Cl. ..... 336/200; 336/83; 336/212; 336/223

(58) Field of Search ..... 336/200, 212, 336/83, 223

(56) References Cited

U.S. PATENT DOCUMENTS 5,506,559 * 4/1996 Yamaguchi ..... 336/83
5,761,791 * 6/1998 Bando ..... 336/200

FOREIGN PATENT DOCUMENTS 24 09 0881 * 9/1975 (EP) ..... 336/200
0 310 396 4/1989 (EP) .
0 782 154 7/1997 (EP) .
58-67007 * 4/1983 (JP) ..... 336/200
4-51502 2/1992 (JP) .
5-135951 6/1993 (JP) .
8-203737 8/1996 (JP) .

* cited by examiner

*Primary Examiner*—Michael L. Gellner
*Assistant Examiner*—Anh Mai
(74) *Attorney, Agent, or Firm*—Keating & Bennett, LLP

(57) ABSTRACT

A coil element includes a composite member located on a first magnetic substrate, a second magnetic substrate disposed on the composite member and an adhesive layer located therebetween. The composite member includes coil patterns and insulating layers. The adhesive layer is composed of a material having a relative magnetic permeability of more than about 1.0. Alternatively, the insulating layers, excluding a portion which surrounds an overlapping region of coil patterns, are composed of a material having a relative magnetic permeability of more than about 1.0. Alternatively, the insulating layers are provided with holes in the approximate central regions of the insulating layers surrounded by the coil patterns, and the holes are filled with the material of the adhesive layer.

28 Claims, 4 Drawing Sheets

COIL ELEMENT

BACKGROUND OF THE INVENTION

1. Field of the Invention

The present invention relates to coil elements, for example, transformers and common mode choke coils.

2. Description of the Related Art

FIG. 4 is a perspective view which shows an example of a common mode choke coil comprising a coil element, and FIG. 5 is an assembly view of the common mode choke coil shown in FIG. 4. The common mode choke coil 1 is disclosed in Japanese Patent Publication No.8-203737, and includes, as shown in FIG. 4, a composite member 7 disposed on a first magnetic substrate 3, a second magnetic substrate 10 disposed on the composite member 7 and an adhesive layer 8 located therebetween, and external electrodes 11 located on the outer surfaces of the first magnetic substrate 3, the composite member 7, the adhesive layer 8, and the second magnetic substrate 10.

As shown in FIG. 5, the composite member 7 includes a plurality of layers deposited by a thin-film fabricating technique such as sputtering, wherein an insulating layer 6*a* composed of a non-magnetic insulating material, for example, a polyimide resin and an epoxy resin, is deposited on the first magnetic substrate 3, leading electrodes 12*a* and 12*b* are disposed on the insulating layer 6*a,* an insulating layer 6*b* is disposed on the leading electrodes 12*a* and 12*b,* a coil pattern 4 and a leading electrode 12*c* extending from the coil pattern 4 are disposed on the insulating layer 6*b,* an insulating layer 6*c* is disposed on the coil pattern 4 and the leading electrode 12*c,* and a coil pattern 5 and a leading electrode 12*d* extending from the coil pattern 5 are disposed on the insulating layer 6*c*.

One end of the coil pattern 4 is electrically connected to the leading electrode 12*a* through a via hole 13*a* provided in the insulating layer 6*b* and the leading electrode 12*a* is electrically connected to an external electrode 11*a*. The other end of the coil pattern 4 is electrically connected to an external electrode 11*c* via the leading electrode 12*c*.

One end of the coil pattern 5 is electrically connected to the leading electrode 12*b* through a via hole 13*c* provided in the insulating layer 6*c* and a via hole 13*b* provided in the insulating layer 6*b,* and the leading electrode 12*b* is connected to an external electrode 11*b*. The other end of the coil pattern 5 is electrically connected to an external electrode 11*d* via the leading electrode 12*d*.

When the common mode choke coil 1 is assembled into a circuit by electrically connecting the individual external electrodes 11 to respective connectors of the circuit, the coil pattern 4 and the coil pattern 5 are assembled into the circuit.

Since the common mode choke coil 1 can be manufactured by a thin-film fabricating technique, for example, sputtering and evaporation, it is easily miniaturized and high productivity can be obtained.

It is important to increase the degree of electromagnetic coupling between coil patterns in a coil element such as, for example, a common mode choke coil or a transformer to improve the electrical characteristics of the coil element. For example, the above-mentioned common mode choke coil can be configured so as to have a high impedance to common mode noise, and thus, the capability of the coil element eliminating common mode noise can be enhanced. Also, a transformer can be configured so as to decrease an energy loss and to increase a bandwidth thereof.

In the common mode choke coil 1 shown in FIG. 4 and FIG. 5, since the insulating layers 6 can be made by a thin-film fabricating technique as described above, the thicknesses of the insulating layers 6 can be reduced. That is, the space between the coil pattern 4 and the coil pattern 5 can be reduced. As the space between the coil patterns 4 and 5 becomes narrower, the degree of electromagnetic coupling between the coil patterns 4 and 5 increases, and thus, the impedance of the common mode choke coil 1 can be increased.

However, in order to reliably provide a certain minimum required insulation quality between the coil pattern 4 and the coil pattern 5, the thicknesses of the insulating layers 6 cannot be reduced limitlessly. Therefore, in the method for increasing the degree of electromagnetic coupling by reducing the thicknesses of the insulating layers 6, and increasing the impedance of the common mode choke coil 1, there are limits to an amount of improvement to the electromagnetic coupling and impedance characteristics. As a result, satisfactory elimination of common mode noise cannot be achieved.

SUMMARY OF THE INVENTION

The preferred embodiments of the present invention overcome the problems described above by providing a coil element which has excellent electrical characteristics obtained by significantly improving the degree of electromagnetic coupling between coil patterns to meet the demand for a common mode choke coil having higher impedance.

To solve the problems of the prior art, the preferred embodiments of the present invention a coil element includes a composite member disposed on a first magnetic substrate. The composite member includes coil patterns and insulating layers which are alternately arranged. A second magnetic substrate is disposed on the composite member with an adhesive layer disposed therebetween. The adhesive layer preferably includes a material having a relative magnetic permeability of more than about 1.0.

In another preferred embodiment, a coil element includes a composite member disposed on a first magnetic substrate. The composite member includes coil patterns and insulating layers which are alternately arranged. A second magnetic substrate is disposed on the composite member with an adhesive layer disposed therebetween. The adhesive layer is composed of a material having a relative magnetic permeability of more than about 1.0, and the insulating layers, excluding a portion which surrounds an overlapping region of the coil patterns, are composed of a material having a relative magnetic permeability of more than about 1.0.

In accordance with another preferred embodiment of the present invention, a coil element includes a composite member disposed on a first magnetic substrate. The composite member includes coil patterns and insulating layers being alternately arranged. A second magnetic substrate is disposed on the composite member with an adhesive layer therebetween. The adhesive layer is composed of a material having a relative magnetic permeability of more than about 1.0, and the insulating layers are provided with holes formed in the central regions surrounded by the coil patterns. The holes in the insulating layers are filled with the material of the adhesive layer.

In accordance with another preferred embodiment of the present invention, a coil element is provided with the structure according to the preferred embodiments described above, wherein the material having a relative magnetic permeability of more than about 1.0 is an insulating material which contains magnetic particles.

In accordance with a fifth aspect of the present invention, the magnetic particles according to the fourth aspect of the present invention are composed of a ferrite. The ferrite magnetic particles according to this preferred embodiment may be Ni—Zn-based or Mn—Zn-based ferrite magnetic particles.

In accordance with preferred embodiments of the present invention having the structures described above, at least the adhesive layer is composed of a material having a relative magnetic permeability of more than about 1.0. Magnetic lines of force generated by the coil patterns form a closed magnetic circuit, for example, which starts from the first magnetic substrate, passes through the insulating layers of the composite member and the adhesive layer in the central region surrounded by coil patterns to reach the second magnetic substrate, passes through the second magnetic substrate, passes through the adhesive layer and the insulating layers of the composite member outside the coil patterns, and returns to the first magnetic substrate. As the relative magnetic permeability of the material of the adhesive layer and the like, through which the magnetic lines of force pass, increases, the magnetic lines of force leaked from the closed magnetic circuit decrease. As a result of the decrease in the leakage of the magnetic lines of force, the degree of electromagnetic coupling between coil patterns in the coil element is increased.

In contrast to preferred embodiments of the present invention, an adhesive layer in conventional coil elements is composed only of a non-magnetic insulating material which has a relative magnetic permeability of 1.0 or less. It was thought that magnetic material could not be used in the adhesive layer of the conventional devices because adding magnetic material, especially magnetic material having a relative magnetic permeability of more than about 1.0, would significantly decrease the adhesiveness of the adhesive layer, and thus, the adhesive layer may not function to adhere two elements to each other. In addition, it was thought that magnetic material, especially that having a relative magnetic permeability of more than about 1.0, could not be used in the adhesive layer because such magnetic material decreases insulation characteristics which is undesirable in the coil element.

However, in accordance with preferred embodiments of the present invention, it was discovered that if at least the adhesive layer is composed of a magnetic material having a relative magnetic permeability of more than about 1.0, the leakage of the magnetic lines of force are prevented and the degree of electromagnetic coupling between coil patterns in the coil element is significantly increased, while still providing sufficient adhesiveness and insulation required of the adhesive layer. Thus, in a common mode choke coil using one of the preferred embodiments of the present invention, the ability to eliminate common mode noise is greatly improved.

These and other elements, features and advantages of the preferred embodiments of the present invention will be apparent from the following detailed description of the preferred embodiments of the present invention, as illustrated in the accompanying drawings.

DETAILED DESCRIPTION OF PREFERRED EMBODIMENTS

Figure 1:
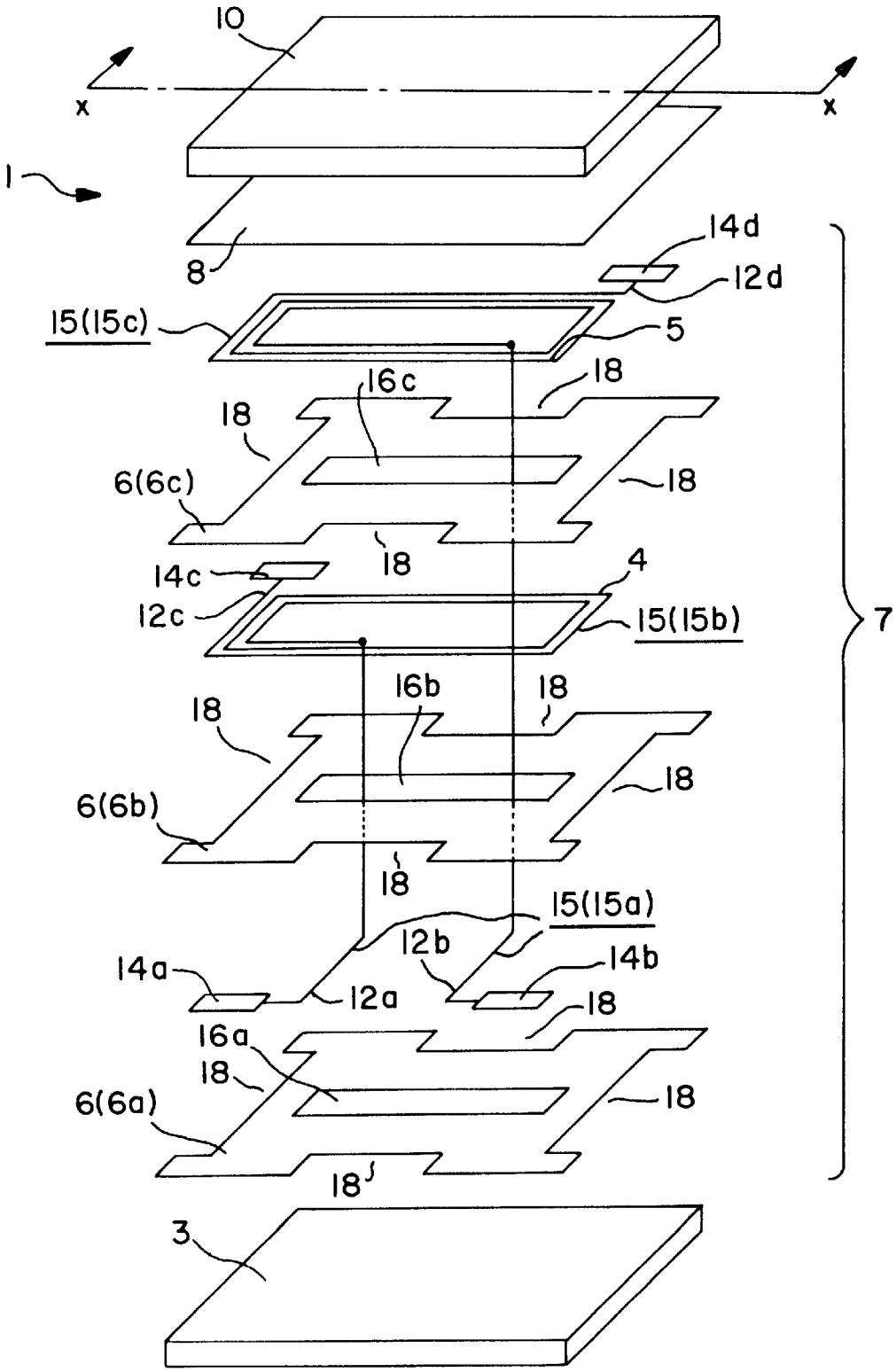
FIG. 1 is a schematic diagram showing a coil element according to a preferred embodiment of the present invention.

Preferred embodiments of the present invention will be described with reference to the drawings. In the following description of preferred embodiments, the same reference numerals are assigned to common or similar elements referred to in the description of the conventional example described above, and the description of the common elements will be omitted.

Figure 2A:
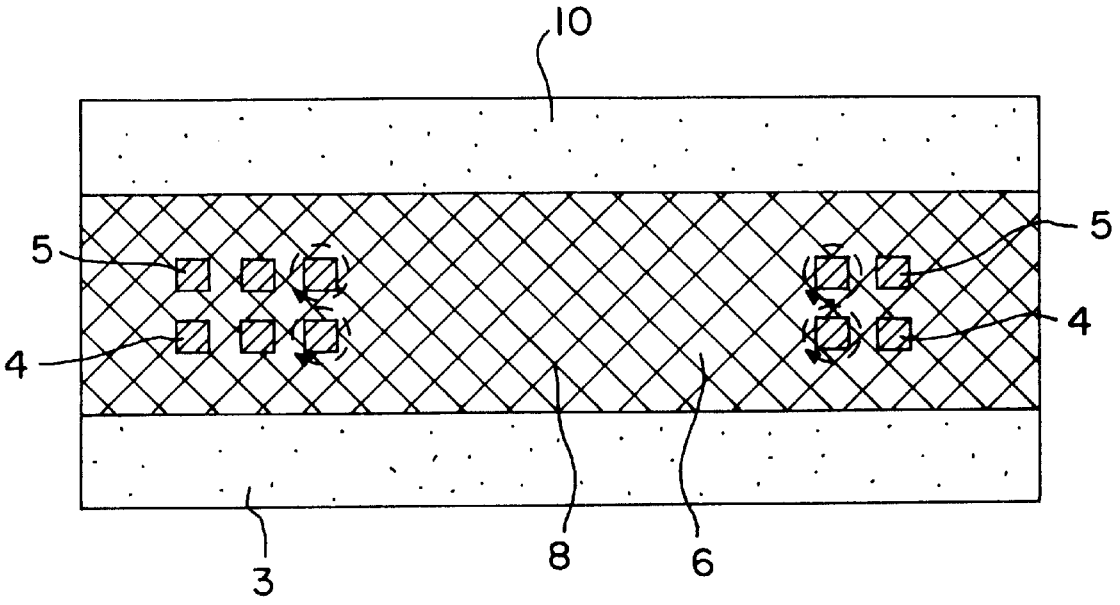
FIG. 2A is an explanatory sectional view when the magnetic material is included into the insulating layers 6 between the coil pattern 4 and the coil pattern 5.
Figure 2B:
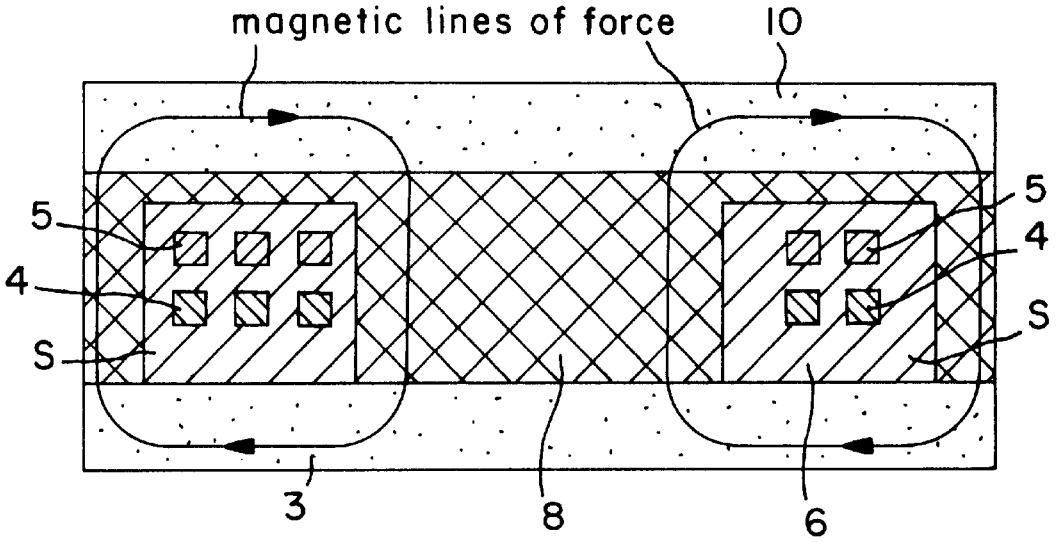
FIG. 2B is a sectional view taken along the line x—x of the coil element shown in FIG. 1.
Figure 3:
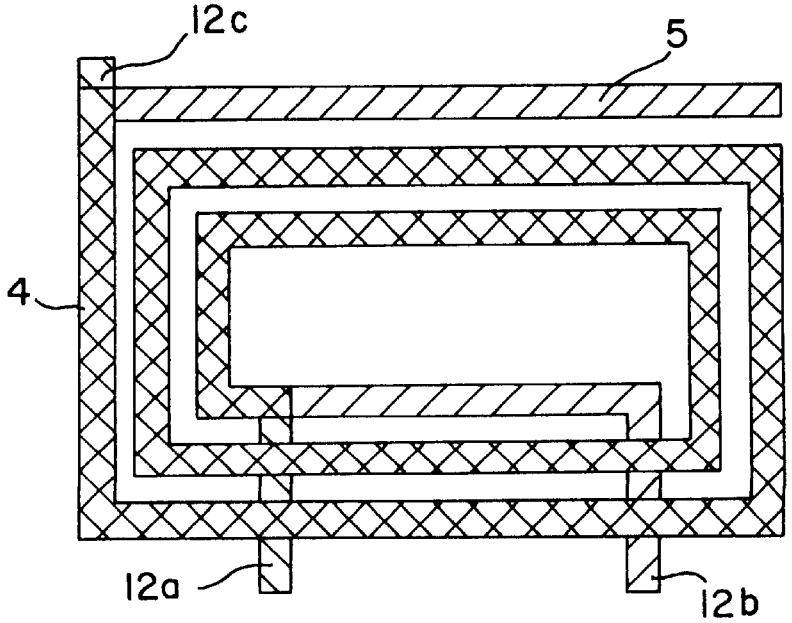
FIG. 3 is a schematic diagram showing coil patterns of the coil element shown in FIG. 1.
Figure 4:
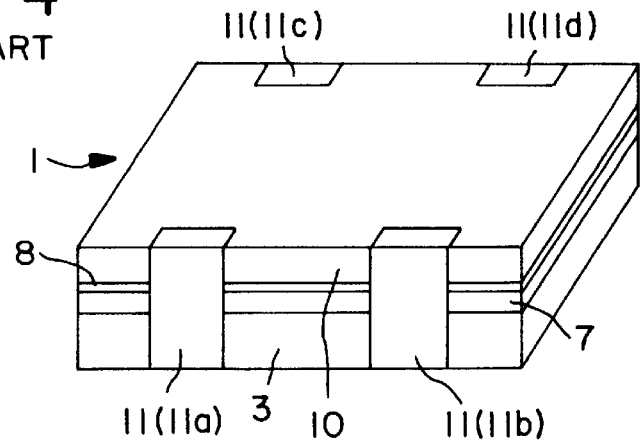
FIG. 4 PRIOR ART
FIG. 4 is a perspective view of an example of a conventional coil element.

FIG. 1 is an assembly view of a common mode choke coil as a coil element according to a preferred embodiment, FIGS. 2A and 2B are a sectional views taken along the line x—x of the common mode choke coil 1 shown in FIG. 1, and FIG. 3 is a top plan view of the common mode choke coil 1, showing the pattern shapes of coil patterns 4 and 5. In this preferred embodiment, by forming an adhesive layer 8 with a material having a relative magnetic permeability of more than about 1.0, the degree of electromagnetic coupling and the impedance in the common mode choke coil 1 are enhanced, and thus, an excellent ability of eliminating common noise is provided in the coil element.

As shown in FIG. 1, an insulating layer 6*a* is preferably disposed on a first magnetic substrate 3 (for example, a Ni—Zn-based ferrite substrate fabricated by powder molding). A conductive pattern layer 15*a,* including leading electrodes 12*a* and 12*b,* an electrode 14*a* electrically connected to the leading electrode 12*a,* and an electrode 14*b* electrically connected to the leading electrode 12*b,* is disposed on the insulating layer 6*a* preferably using a thin-film fabricating technique such as sputtering or other suitable process.

An insulating layer 6*b* is formed on the conductive pattern layer 15*a,* and a conductive pattern layer 15*b,* including a coil pattern 4, a leading electrode 12*c* extending from the coil pattern 4, and an electrode 14*c* electrically connected to the leading electrode 12*c,* is disposed on the insulating layer 6*b* preferably using a thin-film fabricating technique or other suitable process. An inner end of the coil pattern 4 is electrically connected to the leading electrode 12*a.*

An insulating layer 6*c* is disposed on the conductive pattern layer 15*b,* and a conductive pattern layer 15*c* including a coil pattern 5, a leading electrode 12*d* extending from the coil pattern 5, and an electrode 14*d* electrically connected to the leading electrode 12*d,* is disposed on the insulating layer 6*c* preferably using a thin-film fabricating technique or other suitable process. An inner end of the coil pattern 5 is electrically connected to the leading electrode 12*b.*

As described above, a composite member 7 is formed by alternately depositing insulating layers 6 and conductive pattern layers 15 preferably using a thin-film fabricating technique or other suitable process. The conductive patterns, including the coil patterns 4 and 5, leading electrodes 12*a* to 12*d,* and external electrodes 14*a* to 14*d,* are preferably composed of a metal, for example, Ag, Pd, Cu, Ni, Ti, Cr and Al, or an alloy including at least two of the metals. Also, the insulating layers 6*a,* 6*b,* and 6*c* are preferably composed of a non-magnetic insulating material, for example, a resin such as a polyimide resin, an epoxy resin, an acrylic resin, a cyclic olefin resin, and a benzocyclobutene resin, glass, and glass-ceramic.

The insulating layers 6 and the conductive pattern layers 15 can be made to be extremely thin by preferably using a thin-film fabricating technique. In an example of this preferred embodiment, the insulating layers 6 have a thickness of approximately 1 mm to 10 mm, and the conductive pattern layers have a thickness of approximately 1 to approximately 10 mm.

Also, in this preferred embodiment, most parts of the coil pattern 4 and the coil pattern 5 overlap each other as shown in FIG. 3.

In this preferred embodiment, as described above, since the insulating layers 6 are made to be extremely thin and since the coil pattern 4 and the coil pattern 5 overlap each other, the space between the coil pattern 4 and the coil pattern 5 is significantly narrow. As a result, the degree of electromagnetic coupling between the coil pattern 4 and the coil pattern 5 is significantly improved. Of course, the insulating layers 6 reliably and completely insulate the coil pattern 4 and the coil pattern 5, and have thicknesses such that a short circuit or the like does not occur.

Also, in this preferred embodiment, as shown in FIG. 1, the insulating layers 6*a,* 6*b,* and 6*c* of the composite 7 have holes 16*a,* 16*b,* and 16*c,* respectively, disposed in the approximately central regions surrounded by the coil patterns 4 and 5, and cut-outs 18 are preferably made at the peripheries of the insulating layers 6*a,* 6*b* and 6*c.*

In this preferred embodiment, the composite member 7 is preferably configured as described above, and a second magnetic substrate 10 (for example, a Ni—Zn-based ferrite substrate made by powder molding) is adhered on the composite member 7 via an adhesive layer 8. The adhesive layer 8 is preferably composed of a material having a relative magnetic permeability of more than about 1.0 (magnetic material). In this preferred embodiment, since a material having a relative magnetic permeability of more than about 1.0 is obtained by mixing Ni—Zn-based ferrite magnetic particles into an insulating adhesive, for example, polyimide, the adhesive layer 8 is preferably composed of an insulating adhesive containing Ni—Zn-based ferrite magnetic particles. In one example of the preferred embodiments of the present invention, the adhesive layer 8 has a thickness of approximately 6 mm to 60 mm.

Preferably, a material for the adhesive layer 8 has a high relative magnetic permeability, and by increasing the content of the Ni—Zn-based ferrite magnetic particles in the insulating adhesive material for the layer 8, the relative magnetic permeability of the adhesive layer 8 is significantly increased. However, an excessive number of magnetic particles results in decreased adhesive strength of the adhesive material, and the second magnetic substrate 10 easily peels off. Accordingly, the adhesive layer 8 is preferably composed of an adhesive material containing an appropriate number of magnetic particles for preventing the peeling of the second magnetic substrate 10, and the relative magnetic permeability of the adhesive layer 8 reaches about 1.5 or more.

When the second magnetic substrate 10 is bonded on the composite member 7 such that the adhesive layer 8 is located therebetween, the material of the adhesive layer 8 is in a molten state, and thence, the material of the adhesive layer 8 flows into the holes 16 and the cut-outs 18 made in the insulating layers 6, and, as shown in FIGS. 2A and 2B, the holes 16 and the cut-outs 18 are filled completely. In other words, the region between the first magnetic substrate 3 and the second magnetic substrate 10 is preferably composed of a material having a relative magnetic permeability of more than about 1.0, excluding the region S where the coil patterns 4 and 5 are deposited.

As described above, the first magnetic substrate 3, the composite member 7, the adhesive layer 8, and the second magnetic substrate 10 are monolithically fabricated into a block, and external electrodes (not shown in the drawing) which electrically connect to the electrodes 14*a* to 14*d,* respectively, are disposed on the outer surfaces of the block. The coil patterns 4 and 5 are assembled into a circuit with the external electrodes therebetween.

In this preferred embodiment, as described above, the adhesive layer 8 is preferably composed of a material having a relative magnetic permeability of more than about 1.0, and the holes 16 and the cut-outs 18 of the insulating layers 6 are preferably filled with the material of the adhesive layer 8, that is, the region between the first magnetic substrate 3 and the second magnetic substrate 10, excluding the region S where the coil patterns are deposited and the adhesive layer 8 is not provided, is preferably composed of the material having a relative magnetic permeability of more than about 1.0 (magnetic material). Thus, most of the magnetic lines of force generated by the coil patterns 4 and 5 form a closed magnetic circuit as shown by the solid arrow in FIG. 2B, and pass through only the part composed of a material having a relative magnetic permeability of more than about 1.0. Therefore, the material in the magnetic permeation path has a high relative magnetic permeability, and the leakage of the magnetic lines of force decreases considerably, resulting in a significant improvement in the degree of electromagnetic coupling and impedance of the common mode choke coil 1.

Figure 5:
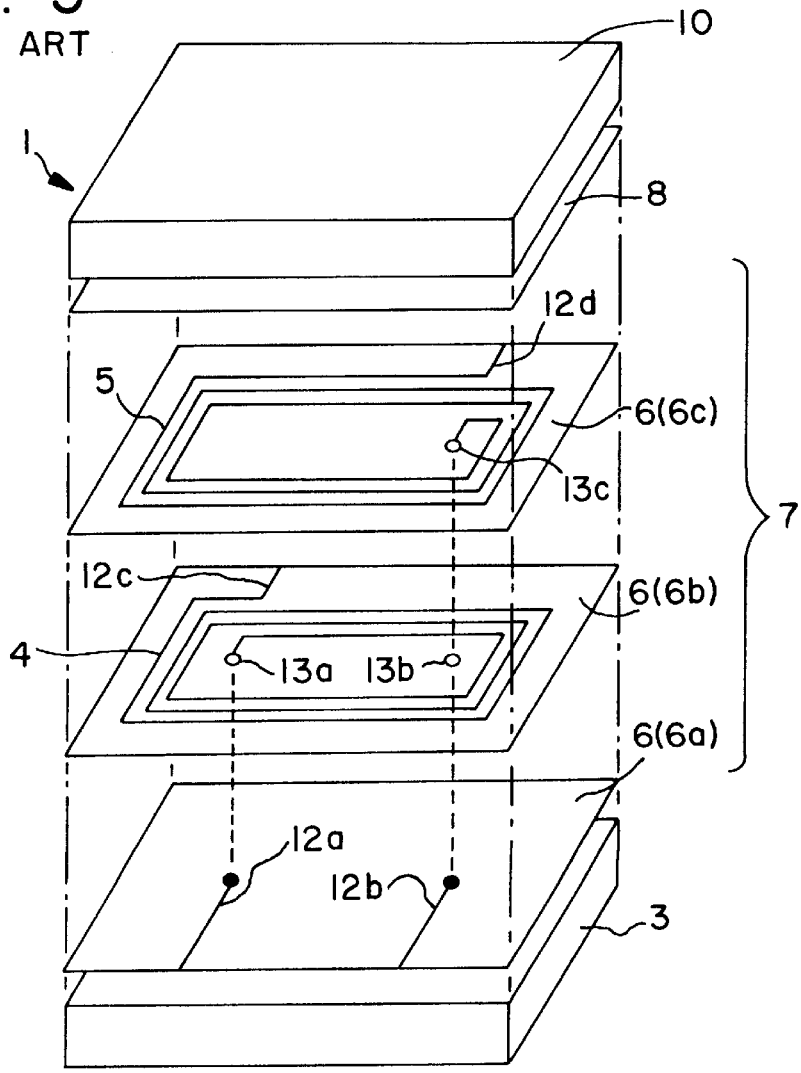
FIG. 5 PRIOR ART
FIG. 5 is an assembly view of the coil element shown in FIG. 4.

In contrast, as shown in FIG. 5, when the region between the first magnetic substrate 3 and the second magnetic substrate 10, excluding the conductive parts, is composed of a non-magnetic material having a relative magnetic permeability of more than about 1.0, the magnetic lines of force generated by the coil patterns 4 and 5 inevitably pass through the parts of the non-magnetic material where the leakage of the magnetic lines of force occur resulting in a decrease in the degree of electromagnetic coupling and a decrease in the impedance of the common mode choke coil 1.

In this preferred embodiment, as described above, since most of the magnetic lines of force pass through only the parts composed of the material having a relative magnetic permeability of more than about 1.0, there is a significantly low leakage amount from the magnetic lines of force. Because of the decrease in the leakage of magnetic lines of force, the degree of electromagnetic coupling and impedance of the common mode choke coil 1 is prevented from decreasing, and a high degree of electromagnetic coupling and a high impedance are obtained. As a result, a common mode choke coil 1 which is highly capable of eliminating common mode noise is achieved.

When the magnetic material is included into the insulating layers 6 between the coil pattern 4 and the coil pattern 5, the relative magnetic permeability of the insulating layers 6 increases, and the magnetic lines of force generated by the coil patterns 4 and 5 form closed magnetic circuits around the wires of the coil patterns 4 and 5 as shown by the dotted arrows in FIG. 2A. As a result, the degree of electromagnetic coupling deteriorates significantly and the common mode choke coil 1 will have inferior electrical characteristics.

In contrast, in this preferred embodiment of the present invention, the insulating layers 6, in the region S where the coil patterns 4 and 5 are deposited, are preferably composed of a non-magnetic material not including a magnetic material, and the region between the first magnetic substrate 3 and the second magnetic substrate 10, excluding the region S, is preferably composed of the material of the adhesive layer 8, i.e., the magnetic material having a relative magnetic permeability of more than about 1.0. As a result, the magnetic lines of force generated by the coil patterns 4 and 5 form the closed magnetic circuit around the region S where the coil patterns are deposited and the adhesive layer is not provided, as shown by the solid arrow in FIG. 2B, instead of the closed magnetic circuits around the wires of the coil patterns 4 and 5. Consequently, the degree of electromagnetic coupling between the coil pattern 4 and the coil pattern 5 is significantly improved, and the deterioration of the electrical characteristics is avoided.

It is to be understood that the present invention is not limited to the preferred embodiments described above, and the invention is intended to cover various modifications and equivalent arrangements. For example, although the adhesive layer 8 is preferably composed of a material including an insulating adhesive which contains Ni—Zn-based ferrite magnetic particles, a material including an insulating adhesive which contains Mn—Zn-based ferrite magnetic particles, or ferrite magnetic particles other than those that are Ni—Zn-based or Mn—Zn-based, or other magnetic materials, for example, magnetic particles other than ferrite may be used. Of course, by mixing a magnetic material into the insulating adhesive, the resulting material will have a relative magnetic permeability of more than about 1.0. Therefore, when a material including an insulating adhesive which contains a magnetic material other than Ni—Zn-based ferrite magnetic particles is used for the adhesive layer 8, the same advantages as described above can be obtained as that of the preferred embodiment described above.

Also, although in the preferred embodiment described above, holes 16 and cut-outs 18 are preferably made in the insulating layers 6, and the material of the adhesive layers 8 is used for filling the holes 16 and the cut-outs 18, another material having a relative magnetic permeability of more than about 1.0 may be used for filling the holes 16 and the cut-outs 18 instead of the material of the adhesive layers 8. Also, although two coil patterns 4 and 5 are used in this preferred embodiment, three coil patterns or more may be deposited with insulating layers therebetween. Also, the number of turns of the coil patterns 4 and 5 is not limited to a specified number as long as it is 1 or more, and may be set up in accordance with the description of preferred embodiments in this specification.

Also, although leading electrodes 12*a* and 12*b* and electrodes 14*a* and 14*b* are preferably disposed on the insulating layer 6*a,* and the coil pattern 4 is located thereon with the insulating layer 6*b* located therebetween, in the preferred embodiment described above, the leading electrode 12*a* and the electrode 14*a* may be located on the insulating layer 6*b,* or the leading electrode 12*b* and the electrode 14*b* may be located on the insulating layer 6*c.* If all of the leading electrodes 12*a* and 12*b* and the electrodes 14*a* and 14*b* are disposed on any of the insulating layers 6 excluding the insulating layer 6*a,* the insulating layer 6*a* can be omitted since there is no conductive material between the insulating layer 6*a* and the insulating layer 6*b.*

Although preferred embodiments have been described with reference to a common mode choke coil, the present invention is also applicable to other coil elements such as a transformer. In the case of a transformer, by increasing the degree of electromagnetic coupling between coil patterns, an energy loss is significantly reduced and a bandwidth is significantly increased.

In accordance with preferred embodiments of the present invention, since the adhesive layer is preferably composed of an adhesive material having an increased relative magnetic permeability of more than about 1.0 by mixing a magnetic material such as Ni—Zn-based and Mn—Zn-based ferrite magnetic particles into an insulating adhesive, the degree of electromagnetic coupling in the coil element is greatly increased. In particular, in accordance with a coil element, wherein in addition to the adhesive layer being composed of a material having a relative magnetic permeability of more than about 1.0, the parts of the insulating layers, excluding the overlapping region of coil patterns, are composed of a material having a relative magnetic permeability of more than about 1.0, or in accordance with a coil element, wherein holes are provided on the insulating layers in the approximately central region surrounded by coil patterns, and the holes are filled with the material of the adhesive layer, most of the magnetic lines of force generating from the coil patterns comprise the parts composed of a material having a relative magnetic permeability of more than about 1.0, and because of the high relative magnetic permeability, the leakage of the magnetic lines of force decreases considerably.

Since the leakage of the magnetic lines of force can be substantially prevented as described above, the degree of electromagnetic coupling in the coil element greatly increases, and the resulting coil element has excellent electrical characteristics.

While the invention has been described and particularly shown with reference to the preferred embodiments thereof, it will be understood by those skilled in the art that the foregoing and other changes in form and details may be made therein without departing from the spirit and scope of the invention.

What is claimed is:

1. A coil element, comprising:

a first magnetic substrate;

a composite member disposed on the first magnetic substrate, said composite member including coil patterns and insulating layers being alternately arranged, each of the insulating layers including at least one of a plurality of holes disposed at an approximate central portion thereof and a plurality of cutout portions disposed at peripheral edges thereof;

a second magnetic substrate disposed on the composite member;

an adhesive material extending between the first magnetic substrate and the second magnetic substrate and located within the at least one of the plurality of holes disposed at an approximate central portion of each of the insulating layers and the cutout portions disposed at peripheral edges of each of the insulating layers, the adhesive material being arranged to completely fill the at least one of the plurality of holes of the insulating layers such that only the adhesive material is located in the at least one of the plurality of holes of the insulating layers.

2. The coil element according to claim 1, wherein the material of the adhesive layer comprises a magnetic material.

3. The coil element according to claim 1, wherein the material of the adhesive layer comprises an insulating material which contains magnetic particles.

4. A coil element according to claim 3, wherein the magnetic particles comprise a ferrite.

5. A coil element according to claim 4, wherein the ferrite magnetic particles comprise Ni—Zn-based or Mn—Zn-based ferrite magnetic particles.

6. A coil element according to claim 1, wherein the first magnetic substrate, the composite member, the second magnetic substrate and the adhesive layer are arranged to define a common mode choke coil.

7. A coil element according to claim 1, wherein the first magnetic substrate, the composite member, the second magnetic substrate and the adhesive layer are arranged to define a transformer.

8. A coil element according to claim 1, wherein the adhesive layer comprises a material having a relative magnetic permeability of about 1.5.

9. A coil element according to claim 1, further comprising an adhesive layer disposed between the composite member and the second magnetic substrate, wherein the adhesive layer comprises a material having a relative magnetic permeability of more than 1.0.

10. A coil element according to claim 1, wherein the adhesive material disposed between the first magnetic substrate and the second magnetic substrate a relative magnetic permeability of more than 1.0.

11. A coil element, comprising:

a first magnetic substrate;

a composite member disposed on the first magnetic substrate, said composite member including coil patterns and insulating layers being alternately arranged, each of the insulating layers including a hole formed therein;

a second magnetic substrate disposed on the composite member; and an adhesive material extending between the first magnetic substrate and the second magnetic substrate and arranged so as to surround each of the coil patterns such that only the adhesive material is disposed in the hole of each of the insulating layers.

12. The coil element according to claim 11, wherein the material having a relative magnetic permeability of more than about 1.0 comprises a magnetic material.

13. A coil element according to claim 11, wherein the first magnetic substrate, the composite member, the second magnetic substrate and the adhesive layer are arranged to define a common mode choke coil.

14. A coil element according to claim 11, wherein the first magnetic substrate, the composite member, the second magnetic substrate and the adhesive layer are arranged to define a transformer.

15. A coil element according to claim 11, wherein the adhesive layer comprises a material having a relative magnetic permeability of about 1.5.

16. A coil element according to claim 11, further comprising an adhesive layer disposed between the composite member and the second magnetic substrate, wherein the adhesive layer comprises a material having a relative magnetic permeability of more than 1.0, and said insulating layers, excluding a portion which surrounds a region where the coil patterns overlap each other, comprise a material having a relative magnetic permeability of more than 1.0.

17. A coil element according to claim 11, wherein the adhesive material disposed between the first magnetic substrate and the second magnetic substrate a relative magnetic permeability of more than 1.0.

18. The coil element according to claim 11, wherein the material having a relative magnetic permeability of more than about 1.0 comprises an insulating material which contains magnetic particles.

19. A coil element according to claim 18, wherein the magnetic particles comprise a ferrite.

20. A coil element according to claim 19, wherein the ferrite magnetic particles comprise Ni—Zn-based or Mn—Zn-based ferrite magnetic particles.

21. A coil element, comprising:

a first magnetic substrate;

a composite member disposed on the first magnetic substrate, said composite member including coil patterns and insulating layers being alternately arranged, each of the insulating layers including a hole disposed at an approximate central portion thereof and a plurality of cutout portions disposed at peripheral edges thereof;

a second magnetic substrate disposed on the composite member;

an adhesive material extending between the first magnetic substrate and the second magnetic substrate and located within the hole disposed at an approximate central portion of each of the insulating layers, the adhesive material being arranged so as to surround each of the coil patterns and such that only the adhesive material is located in the hole and the cutout portions of each of the insulating layers.

22. The coil element according to claim 21, wherein the material of the adhesive layer comprises a magnetic material.

23. A coil element according to claim 21, wherein said insulating layers comprise cut-outs formed at end portions of the insulating layers, said cut-outs being filled with the material of the adhesive layer.

24. A coil element according to claim 21, further comprising an adhesive layer disposed between the composite member and the second magnetic substrate, wherein the adhesive layer comprises a material having a relative magnetic permeability of more than 1.0.

25. A coil element according to claim 21, wherein the adhesive material disposed between the first magnetic substrate and the second magnetic substrate a relative magnetic permeability of more than 1.0.

26. The coil element according to claim 21, wherein the material of the adhesive layer comprises an insulating material which contains magnetic particles.

27. The coil element according to claim 26, wherein the magnetic particles comprise a ferrite including Ni—Zn-based or Mn—Zn-based ferrite magnetic particles.

28. A coil element, comprising:

a first magnetic substrate;

a composite member disposed on the first magnetic substrate, said composite member including coil patterns and insulating layers being alternately arranged;

a second magnetic substrate disposed on the composite member;

wherein each of the insulating layers has a hole connecting the first magnetic substrate and the second magnetic substrate, the hole is disposed at a portion enclosed by the coil patterns, an adhesive comprising a magnetic material having a relative magnetic permeability of more than 1.0 is arranged to fill the hole of each of the insulating layers such that only the adhesive is located in the hole of each of the insulating layers, and the first magnetic substrate and the second magnetic substrate are bonded by the adhesive.

* * * * *